US006551077B2

(12) United States Patent
Chou

(10) Patent No.: US 6,551,077 B2
(45) Date of Patent: Apr. 22, 2003

(54) AIR COMPRESSOR HAVING DOUBLE PUMPING SYSTEM

(76) Inventor: Wen San Chou, No. 1-25, Kang Wei Village, An Din Hsiang, Tainan Hsien (TW), 745

( * ) Notice: Subject to any disclaimer, the term of this patent is extended or adjusted under 35 U.S.C. 154(b) by 89 days.

(21) Appl. No.: 09/820,605

(22) Filed: Mar. 30, 2001

(65) Prior Publication Data

US 2002/0141890 A1 Oct. 3, 2002

(51) Int. Cl.[7] ..... F04B 17/00
(52) U.S. Cl. ..... 417/415
(58) Field of Search ..... 417/360, 533, 417/552, 415, 521

(56) References Cited

U.S. PATENT DOCUMENTS 4,334,839 A * 6/1982 Flagg ..... 417/536
4,836,755 A * 6/1989 Nitsche et al. ..... 417/368
5,215,447 A 6/1993 Wen ..... 417/415
5,358,385 A * 10/1994 Wang ..... 417/44.8
5,655,887 A 8/1997 Chou ..... 417/63
6,059,542 A * 5/2000 Chou ..... 417/360
6,146,112 A 11/2000 Chou ..... 417/360
6,200,110 B1 * 3/2001 Chou ..... 417/415
6,213,725 B1 * 4/2001 Chou ..... 417/63
6,227,821 B1 * 5/2001 Leu et al. ..... 417/423.14
6,280,163 B1 * 8/2001 Chou ..... 417/550

* cited by examiner

*Primary Examiner*—Charles G. Freay
*Assistant Examiner*—William H. Rodriguez
(74) *Attorney, Agent, or Firm*—Charles E. Baxley

(57) ABSTRACT

An air compressor includes two housings secured to a base and each having a piston slidably received in the housings. A weight is rotatably secured to the base and includes an eccentric pin rotatably coupled to the piston rods for moving the pistons relative to the housings to conduct the pumping operations. A motor is secured to the base and has a pinion. A gear is rotatably secured to the base with the pivot shaft and engaged with the pinion and driven by the motor via the pinion. The housings may be adjustably secured to the base.

15 Claims, 4 Drawing Sheets

AIR COMPRESSOR HAVING DOUBLE PUMPING SYSTEM

BACKGROUND OF THE INVENTION

1. Field of the Invention

The present invention relates to an air compressor, and more particularly to an air compressor having a double pumping system.

2. Description of the Prior Art

The present applicant has developed various kinds of typical air compressors. U.S. Pat. No. 5,215,447 to Wen, U.S. Pat. No. 5,655,887 to Chou, and U.S. Pat. No. 6,146,112 to Chou discloses three of the typical air compressors which comprise a single piston slidably received in a housing and coupled to a motor via an eccentric. The piston may be actuated to conduct a single pumping operation when the eccentric is rotated for one cycle by the motor.

The present invention has arisen to mitigate and/or obviate the afore-described disadvantages of the conventional air compressors.

SUMMARY OF THE INVENTION

The primary objective of the present invention is to provide an air compressor including a double pumping system for conducting two pumping operations when the eccentric is rotated for one cycle by the motor and for increasing the pumping efficiency of the air compressor.

In accordance with one aspect of the invention, there is provided an air compressor comprising two housings each including a chamber formed therein, a piston slidably received in the chamber of each of the housings, the pistons each including a rod extended therefrom, and means for actuating the pistons to move relative to the housings and to conduct pumping actions of the pistons simultaneously in a reciprocating action.

A pin may further be provided and rotatably coupled to the rods of the pistons, the actuating means is provided for rotating the pin in the reciprocating action and includes a motor having a spindle, the pin is eccentrically secured to the spindle.

A base is further provided for supporting and securing the housings. The actuating means includes a weight rotatably secured to the base with a pivot shaft, the pin is extended from the weight and eccentric relative to the pivot shaft.

The actuating means further includes a pinion provided on the motor, a gear rotatably secured to the base with the pivot shaft and engaged with the pinion and driven by the motor via the pinion. The gear includes a peripheral wall extended therefrom for receiving the weight therein and for allowing the weight and the gear to be rotated in concert with each other.

A device is further provided for adjustably securing the housings to the base. The base includes two ends, the adjustably securing means includes at least one extension extended from each of the housings and adjustably secured to the base. The ends of the base each includes a plurality of holes therein for selectively aligning with the extension of the housings.

A first hose is further provided and coupled between the housings for coupling the housings together. The housings each includes a tube extended therefrom, the first hose is coupled between the tubes of the housings.

The housings each includes a passage formed therein and communicated between the chambers of the housings and the tubes respectively, the tubes each includes a pipe extended outward therefrom and coupled to the first hose.

A nozzle is further provided and connected to the pipe of a first of the housings. The tubes each includes a check valve received therein for controlling an air flowing through the tubes.

The check valves each includes a valve member slidably received in the tubes respectively, and means for biasing the valve member to block the passage of the housing and to prevent air from flowing from the tube to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
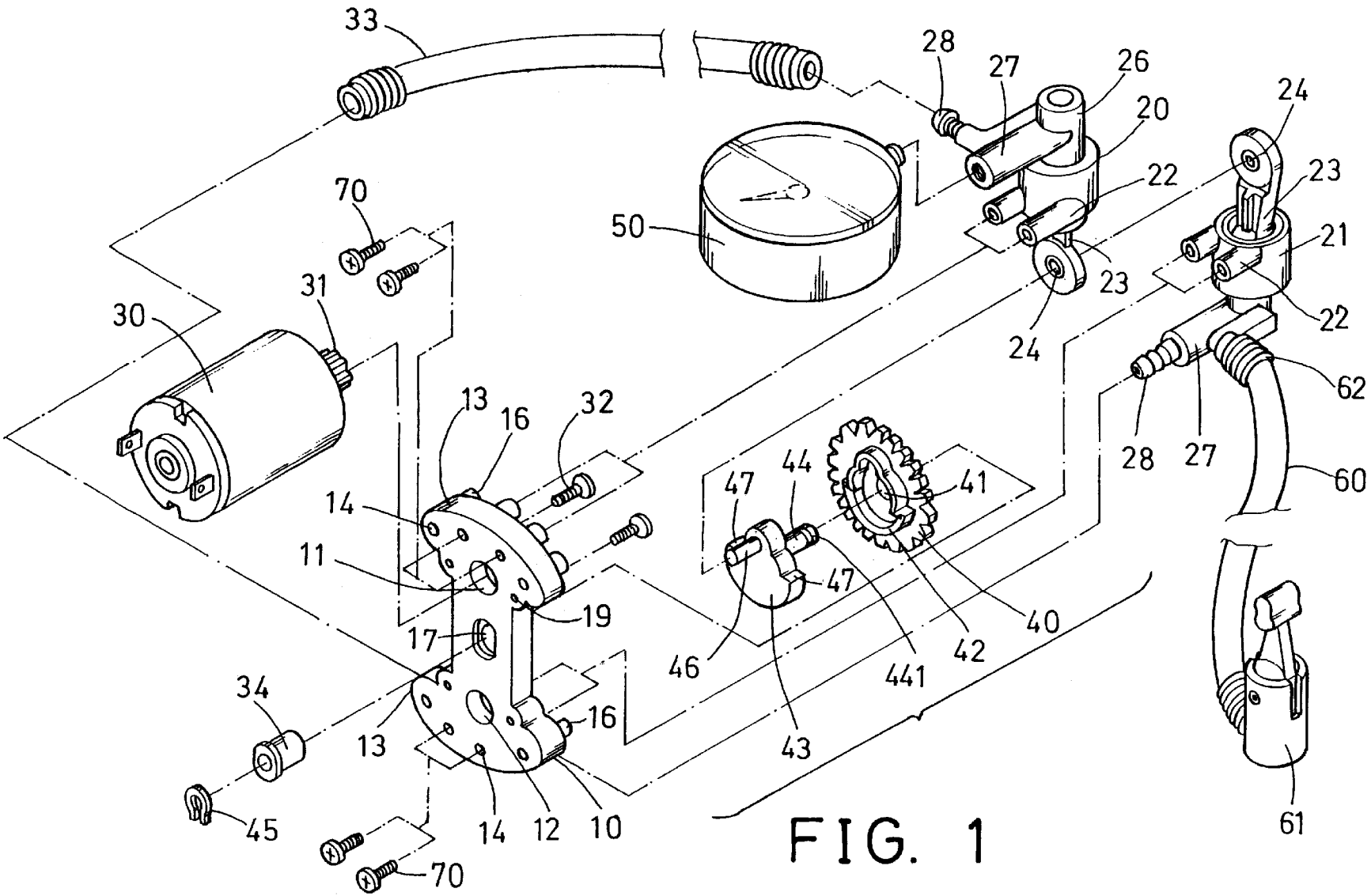
FIG. 1 is an exploded view of an air compressor in accordance with the present invention.
Figure 2:
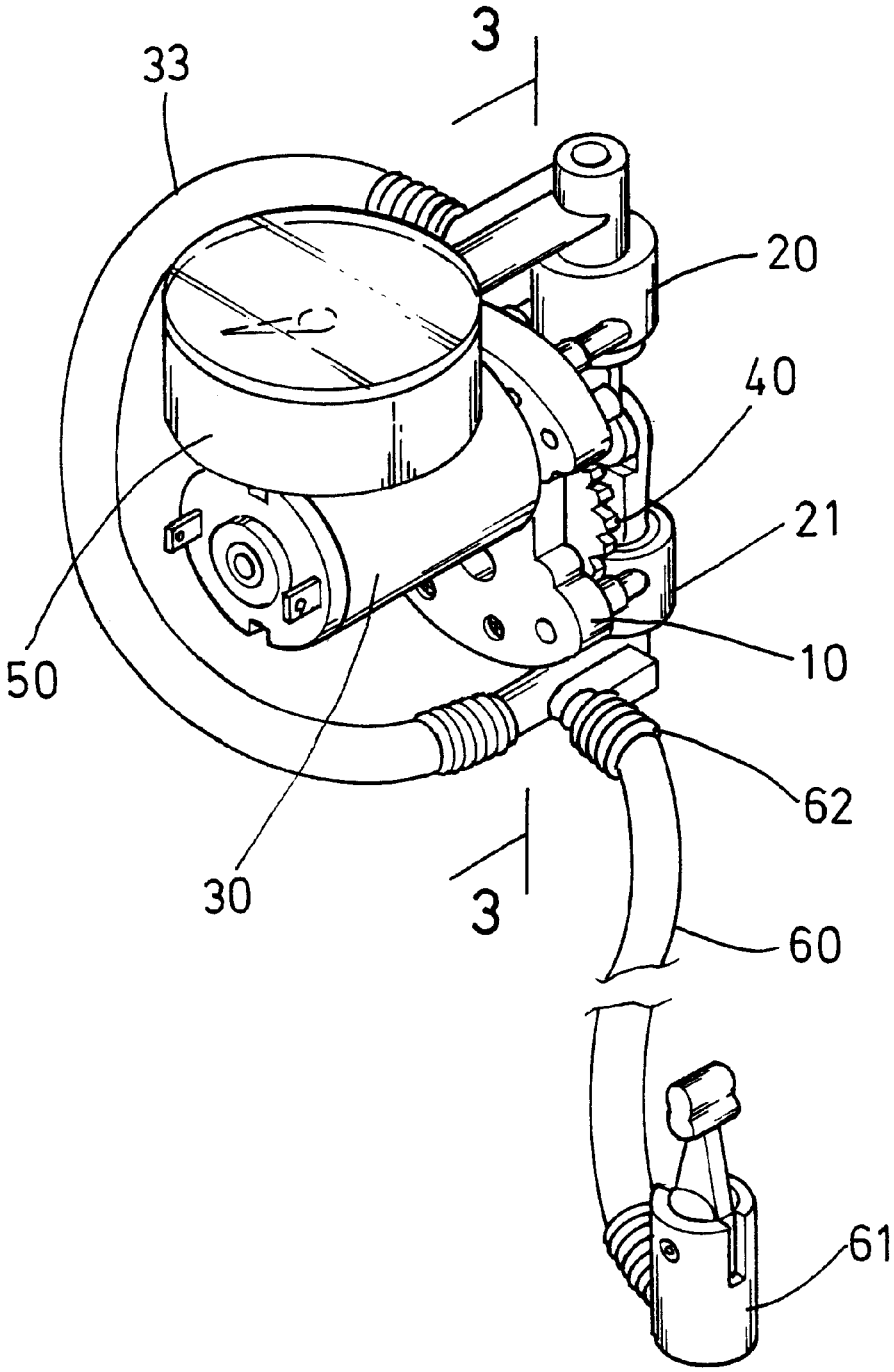
FIG. 2 is a perspective view of the compressor.
Figure 3:
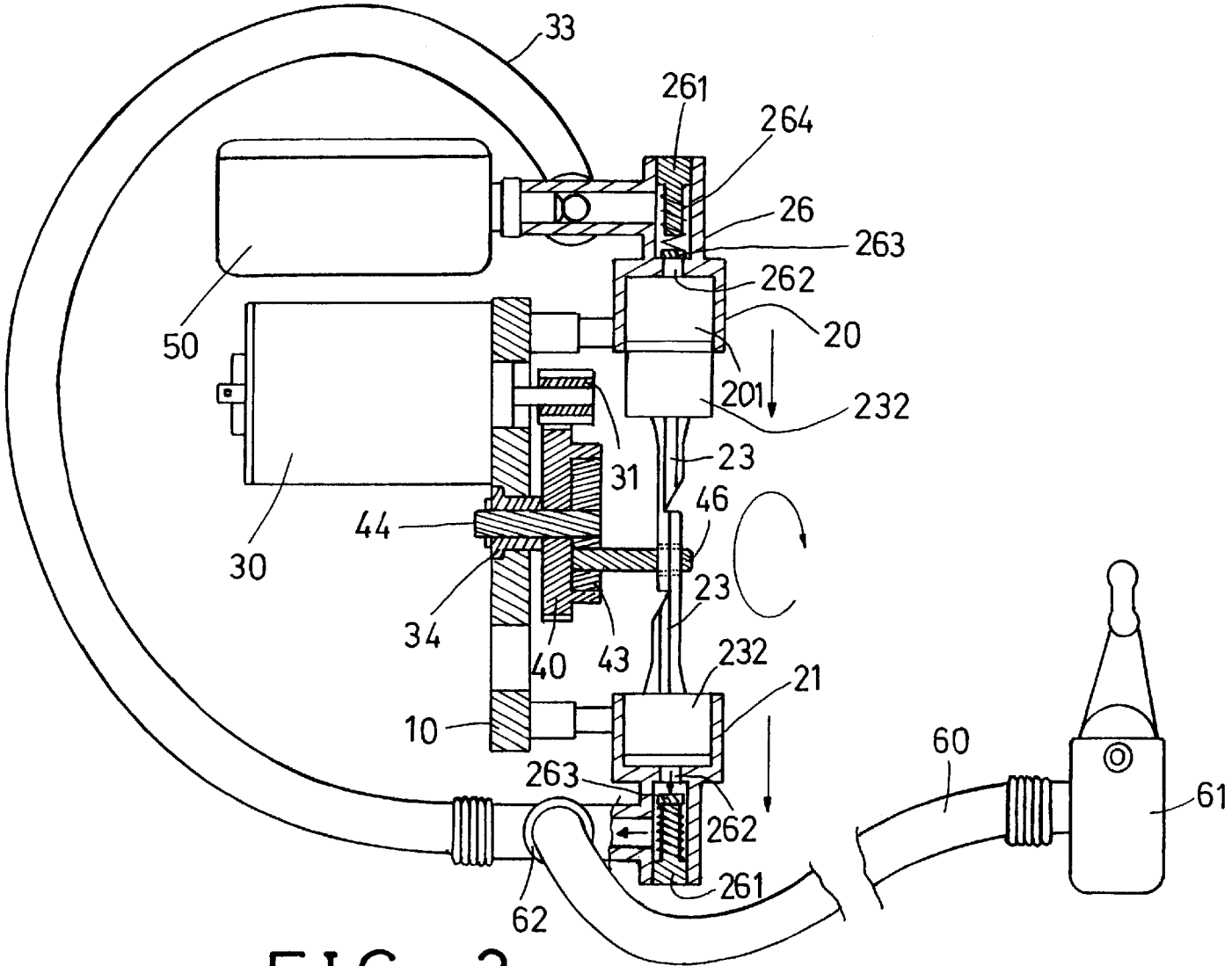
FIG. 3 is a cross sectional view taken along lines 3—3 of FIG. 2.

Referring to the drawings, and initially to FIGS. 1–3, an air compressor in accordance with the present invention comprises a base 10 including an opening 11 formed therein for receiving a pinion 31 of a motor 30 which is secured to the base 10 by such as the fasteners 32 that are engaged through the holes 19 of the base 10 and are threaded to the screw holes of the motor 30 for securing the motor 30 to the base 10. The base 10 includes an orifice 12 and an aperture 17 formed therein and separated from each other. A weight 43 includes a pivot shaft 44 extended outward therefrom and engaged through the aperture 17 of the base 10 and rotatably secured to the base 10 with a clamping ring 45 which is engaged with an annular groove 441 of the pivot shaft 44. A bushing 34 is engaged in the aperture 17 of the base 10 and is engaged between the pivot shaft 44 and the base 10 for rotatably securing and supporting the pivot shaft 44 to the base 10.

A gear 40 includes a hole 41 formed therein for receiving the pivot shaft 44 and for rotatably securing to the base 10 with the pivot shaft 44 and includes a peripheral wall 42 extended therefrom for engaging with one or more shoulders 47 of the weight 43 or for receiving the weight 43 and for rotating the weight 43 such that the weight 43 and the gear 40 rotate in concert with each other. The weight 43 includes a pin 46 extended therefrom or secured thereto and spaced from the pivot shaft 44 or off-set or eccentric relative to the pivot shaft 44 and extended away from the pivot shaft 44 and parallel to the pivot shaft 44. The gear 40 is engaged with the pinion 31 of the motor 30 and may thus be driven by the motor 30. The base 10 includes an enlarged member 13 provided on the upper portion and the lower portion thereof and each having a number of holes 14 formed therein and/or defined by a hub 16 or the like.

Two housings 20, 21 each includes one or more extensions 22 extended therefrom and aligned with either of the holes 14 of the base 10 and secured to the base 10 with fasteners 70 or the like. The housings 20, 21 may thus be adjusted relative to the base 10. The housing 20, 21 each includes a tube 26 extended therefrom, and a pipe 27 extended from the tube 26. The pipes 27 each includes a port 28. A hose 33. is coupled between the ports 28 of the housings 20, 21 for coupling the housings 20, 21 together. The pipe 27 of the housing 21 is coupled to a nozzle 61 and/or a hose 60 via a coupler 62 for output the pressurized air generated by the compressor. An air gage or a pressure gage 50 is coupled to the pipe 27 of the housing 20 for measuring the air pressure in the housing 20. The housing 20, 21 each includes a chamber 201 (FIGS. 3, 4) formed therein for slidably receiving a piston 232, and each includes a passage 262 formed therein (FIGS. 3, 4) for communicating the chamber 201 of the housing 20, 21 with the tube 26. The pistons 232 each includes a rod 23 extended therefrom and having an orifice 24 formed therein for rotatably receiving and securing the pin 46 of the weight 43 by such as a bearing device, such that the pistons 232 may both be moved along the chamber 201 of the housing 20, 21 in a reciprocating action by the motor 30 via the eccentric pin 46 of the weight 43.

Figure 4:
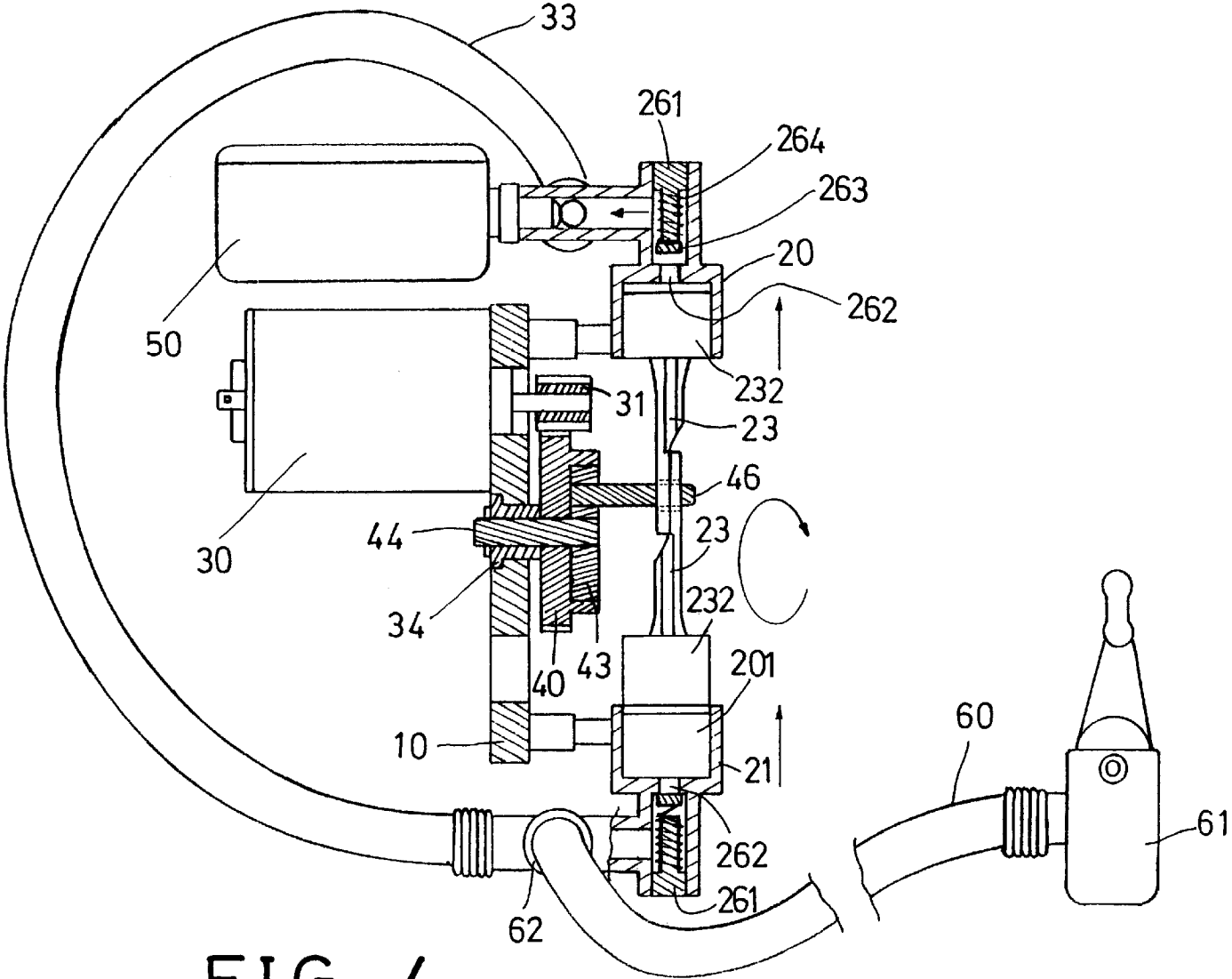
FIG. 4 is a cross sectional view similar to FIG. 3, illustrating the operation of the air compressor.

As shown in FIGS. 3 and 4, the tubes 26 each includes a control valve, such as a check valve received therein for controlling the pressurized air to flow from the housing 20, 21 to the coupler 62 only and for preventing the pressurized air to flow back into the housing 20, 21. The check valves each includes a valve member 263 slidably received in the tubes 26 respectively, a spring 264 engaged with the valve member 263 for biasing the valve member 263 to block the passage 262 of the housing 20, 21. A cap 261 is secured in one end of the tube 26 for retaining the spring 264 and the valve member 263 within the tube 26.

It is to be noted that the motor 30 and the gear 40 and the weight 43 may be attached onto the base 10 before the base 10 is secured to the housing 20, 21. The base 10 may be easily and quickly secured to the housing 20, 21 with the fasteners 70 after the pin 46 of the weight 43 is engaged through the orifices 24 of the rods 23, such that the air compressor may be easily manufactured and assembled.

In operation, as shown in FIGS. 3 and 4, the pistons 232 may be moved along the chamber 201 of the housing 20, 21 in a reciprocating action by the motor 30 via the eccentric pin 46 of the weight 43. The air received in the chambers 201 of the housings 20, 21 may be forced through the passages 262 of the housings 20, 21 and may force the valve member 263 against the spring 264 such that the air may be forced into the tubes 26 and may be forced to the nozzle 61 by the pumping action of the motor 30. As shown in FIG. 3, the piston 232 of the housing 21 may be moved downward or inward of the housing 21 to conduct a pumping action when the eccentric pin 46 of the weight 43 is rotated or moved to the lower portion. At this moment, the piston 232 of the housing 20 is moved outward of the housing 20 in an air intake action. As shown in FIG. 4, the piston 232 of the housing 20 may be moved upward or inward of the housing 20 to conduct a pumping action when the eccentric pin 46 of the weight 43 is rotated or moved to the upper portion. At this moment, the piston 232 of the housing 21 is moved outward of the housing 21 in an air intake action. Accordingly, when the eccentric is rotated for one cycle by the motor, the pistons 232 of the housings 20, 21 may be forced to conduct a pumping operation each and alternatively, such that the air compressor may include a double pumping system for conducting two pumping operations and for increasing the pumping efficiency of the air compressor.

The eccentric pin 46 is eccentrically and rotatably secured to the base 10 with the weight 43 and is acted as a crank, such that the weight 43 and the eccentric pin 46 may also be replaced by a crank or the like which may be rotated to actuate the rods 23 of the housings 20, 21 alternatively in the reciprocating actions. Relatively, the eccentric pin 46 may be actuated to move the pistons 232 relative to the housings 20, 21 simultaneously or alternatively. The pin 46 is pivotally or rotatably coupling the rods 23 of the housings 20, 21 together.

It is to be noted that the housings 20, 21 may be adjustably secured to the base 10 with the fasteners 70 that are engaged through the different holes 14 of the base 10, such that the housings 20, 21 may be adjusted relative to each other and such that the housings 20, 21 may be easily secured to the base 10 according to the support member for the housings and the base. The motor 30, particularly the spindle of the motor 30 may be directly coupled to the rods 23 of the housings 20, 21 with such as a crank or the like, in order to actuate the rods 23 of the housings 20, 21 alternatively without the gear 40 and the weight 43.

The pinion 31 of the motor 30, as shown in the drawings, is engaged into the opening 11 of the base 10. However, alternatively, the pinion 31 of the motor 30 may also be engaged into the orifice 12 of the base 10 and engaged with the gear 40, such that the gear 40 and the weight 43 may also be rotated or driven by the motor 30 with the pinion 31.

Accordingly, the air compressor in accordance with the present invention includes a double pumping system for conducting two pumping operations when the eccentric is rotated for one cycle by the motor and for increasing the pumping efficiency of the air compressor.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

two housings each including a chamber formed therein, a piston slidably received in said chamber of each of said housings, said pistons each including a rod extended therefrom, means for actuating said pistons to move relative to said housings and to conduct pumping actions of said pistons simultaneously in a reciprocating action, and a first hose coupled between said housings for coupling said housings together.

2. The air compressor according to claim 1 further comprising a pin rotatably coupled to said rods of said pistons, said actuating means being provided for rotating said pin in the reciprocating action.

3. The air compressor according to claim 2, wherein said actuating means includes a motor having a spindle, said pin is eccentrically secured to said spindle.

4. The air compressor according to claim 1 further comprising a base, said housings being secured to said base.

5. The air compressor according to claim 4 further comprising means for adjustably securing said housings to said base.

6. The air compressor according to claim 1, wherein said housings each includes a tube extended therefrom, said first hose is coupled between said tubes of said housings.

7. The air compressor according to claim 6, wherein said housings each includes a passage formed therein and communicated between said chambers of said housings and said tubes respectively, said tubes each includes a pipe extended outward therefrom and coupled to said first hose.

8. The air compressor according to claim 7 further comprising a nozzle connected to said pipe of a first of said housings.

9. The air compressor according to claim 6, wherein said tubes each includes a check valve received therein for controlling an air flowing through said tubes.

10. The air compressor according to claim 9, wherein said check valves each includes a valve member slidably received in said tubes respectively, and means for biasing said valve member to block said passage of said housing and to prevent air from flowing from said tube to said housing.

11. An air compressor comprising:

two housings each including a chamber formed therein, a piston slidably received in said chamber of each of said housings, said pistons each including a rod extended therefrom, means for actuating said pistons to move relative to said housings and to conduct pumping actions of said pistons simultaneously in a reciprocating action, and a base, said housings being secured to said base, said actuating means including a weight rotatably secured to said base with a pivot shaft, a pin extended from said weight and eccentric relative to said pivot shaft.

12. The air compressor according to claim 11, wherein said actuating means further includes a motor secured to said base and having a pinion provided thereon, a gear rotatably secured to said base with said pivot shaft and engaged with said pinion and driven by said motor via said pinion.

13. The air compressor according to claim 12, wherein said gear includes a peripheral wall extended therefrom for receiving said weight therein and for allowing said weight and said gear to be rotated in concert with each other.

14. An air compressor comprising:

two housings each including a chamber formed therein, a piston slidably received in said chamber of each of said housings, said pistons each including a rod extended therefrom, means for actuating said pistons to move relative to said housings and to conduct pumping actions of said pistons simultaneously in a reciprocating action, a base including two ends, said housings being secured to said base, and means for adjustably securing said housings to said base, said adjustably securing means including at least one extension extended from each of said housings and adjustably secured to said base.

15. The air compressor according to claim 14, wherein said ends of said base each includes a plurality of holes therein for selectively aligning with said at least one extension of said housings.

* * * * *